US005321855A

United States Patent [19]

Ciuffo

[11] Patent Number: 5,321,855

[45] Date of Patent: Jun. 21, 1994

[54] FASTENING SYSTEM FOR PAIRING SOCKS, HOSIERY AND GLOVES

[75] Inventor: Anthony F. Ciuffo, Franklin Square, N.Y.

[73] Assignee: Ronald J. Chisena, Franklin Square, N.Y.

[21] Appl. No.: 30,785

[22] Filed: Mar. 12, 1993

[51] Int. Cl.[5] ..... A41B 11/00

[52] U.S. Cl. ..... 2/239; 2/912; 2/917; 2/919; 24/444; 24/DIG. 29

[58] Field of Search ..... 2/239, DIG. 6, 160, 2/161.4, 240, 61, 919, 920, 243.1, 901-912; 24/442, 444, 446, DIG. 29, 447; 428/100

[56] References Cited

U.S. PATENT DOCUMENTS

| | | | |
|---|---|---|---|
| 2,663,877 | 12/1953 | Bohman | 2/239 |
| 2,667,004 | 1/1954 | Sanson | 2/239 |
| 3,423,764 | 1/1969 | Cassling | 2/DIG. 6 |
| 3,508,280 | 4/1970 | Osborn | 2/159 |
| 3,688,348 | 9/1972 | Klotz et al. | 24/DIG. 29 |
| 4,058,853 | 11/1977 | Boxer et al. | 2/239 |
| 4,106,126 | 8/1978 | Traenkle | 2/DIG. 6 |
| 4,165,555 | 8/1979 | Boxer et al. | 2/DIG. 6 |
| 4,672,722 | 6/1987 | Malamed | 2/DIG. 6 |
| 4,691,387 | 9/1987 | Lopez | 2/DIG. 6 |
| 4,714,096 | 12/1987 | Guay | 2/DIG. 6 |
| 4,975,985 | 12/1990 | Stimpson | 2/DIG. 6 |
| 5,038,413 | 8/1991 | Ursino | 2/239 |
| 5,136,726 | 8/1992 | Kellin et al. | 2/DIG. 6 |

*Primary Examiner*—Clifford D. Crowder
*Assistant Examiner*—Amy B. Vanatta
*Attorney, Agent, or Firm*—Hoffmann & Baron

[57] ABSTRACT

An improved hook and loop reusable and reclosable fastening system for pairing socks, hosiery and gloves. The fastening system is permanently attached to the socks and hosiery. A preferred embodiment includes an elastic or other stretchable backing material attached to each hook and loop panel preferably made up of thin separable strips which can move with the expansion and contraction of the sock and attachment material. Another preferred embodiment includes several thin strips of the hook and loop panels attached directly to each sock, so that the sock itself can serve as a stretchable backing material. Another preferred embodiment is that each hook and loop panel, respectively, is attached to a logo or decorative pattern on the sock to camouflage the particular hook and loop panel. The products, such as socks, hosiery, gloves and the like can be attached by the hook and loop attachment means for washing, drying and storage. The VELCRO type fasteners are able to withstand the high temperature and forces encountered during the washing and drying process.

7 Claims, 5 Drawing Sheets

FASTENING SYSTEM FOR PAIRING SOCKS, HOSIERY AND GLOVES

BACKGROUND OF THE INVENTION

1. Field of Invention

The present invention relates to apparatus for pairing socks, hosiery and gloves, and more particularly, relates to an improved staggered fastening structure for holding hosiery pairs together during laundry and storage.

2. Background of the Related Art

The household chore of matching pairs of socks or hosiery that have been laundered is tedious and time-consuming. A variety of mechanical holding apparatus has been designed to retain pairs of socks and hosiery together during and after laundering. Clips and pins may damage the socks during laundering and may not be available when the socks are placed in a laundry bin. Perforated packets or bags which can be used in the washing machines are another solution to this problem, however, these are time intensive and require bagging each pair of socks prior to washing.

Another attempt to solve this problem is described in U.S. Pat. No. 3,688,348 to Klotz which utilizes bands that are wrapped around the shank of the socks to keep the pair together during washing. Such bands, however, must be available when the socks are placed in the laundry bin, otherwise, the socks must be paired prior to washing.

To solve this problem, various fasteners have been described as being affixed directly on each of the socks. For example, snaps and hook and eye fasteners have been disclosed. However, snaps and hook and eye fasteners are usually stiff and inflexible resulting in pulling during washing and drying. This results in stretching and tearing of the socks. Additionally, stiff and inflexible fasteners may be uncomfortable if pressed into the wearer's leg.

Tie strings have also been disclosed as being sewn to the socks pair. However, these are cumbersome and may become tangled or permanently knotted together.

More recently, Boxer et. al. in U.S. Pat. Nos. 4,165,555 and 4,058,853 have taken advantage of hook- and pile VELCRO type fasteners which are described in U.S. Pat. Nos. 3,000,384 and 3,009,235. The Boxer et. al. patents describe the general concept of attaching socks, gloves and other items together using a patch containing a hook type fastener on one sock and a patch containing a loop type fastener on another. See, for example, FIGS. 1 and 2. Both patents also describe the use of a sewn on backing or a heat activated adhesive such as an iron on patch or other adhesives to attach the fasteners to the socks. Both Boxer et. al. patents are particularly concerned with covering the hook portions of the fastener with a cover containing complementary piece of material, i.e. a loop structure, and having such flap being an integral part of the patch. This is shown in FIGS. 3 and 4.

A disadvantage of the Boxer et. al. concept is that the VELCRO portion is relatively inelastic while the shank of typical socks stretch when placed on the user's calf. Thus, the VELCRO strap may tear off or become partially detached after use. In addition, due to the inflexibility of the fasteners of Boxer et. al., if the fasteners are sewn on or adhered too strongly to be pulled off during repeated use, the sock fabric would be pulled, stretched and eventually may even tear. Also, the VELCRO patch described by Boxer et. al. is highly visible and may be unfashionable when the socks are exposed, i.e. when shorts or a skirt is worn.

Socks utilizing VELCRO attachment means for purposes other than holding pairs of socks together are described in U.S. Pat. Nos. 4,106,126 and 3,938,264.

SUMMARY OF THE INVENTION

The disadvantages of the prior art sock and hosiery fasteners have now been overcome by the present invention, which provides an improved hook and loop reusable and reclosable fastening system for pairing socks, hosiery and gloves. The fastening system is permanently attached to and becomes an integral part of the socks, hosiery and gloves. One preferred embodiment of this invention includes an elastic or other stretchable material attached to each hook and loop panels which are preferably made up of thin separable strips that can move with the expansion and contraction of the sock and attachment material. Another preferred embodiment includes several thin strips of the hook and loop panels attached directly to each sock, so that the sock itself can serve as a stretchable backing material. Another preferred embodiment is that each of the hook and loop panels, respectively, are attached and made a part of a logo or decorative pattern on the sock to camouflage the particular hook and loop panels. The products, such as socks, hosiery, gloves and the like can be held together by the hook and loop attachment means for washing, drying and storage. The VELCRO type fasteners are able to withstand the high temperatures and forces encountered during washing and drying process.

For a better understanding of the present invention, reference is made to the following description and Examples taken in conjunction with the accompanying figures, the scope of which is pointed out in the appended claims.

BRIEF DESCRIPTION OF THE DRAWINGS

FIG. 7A shows a colored pair of socks (e.g., here the hatching is for green) utilizing the first preferred fastening system of the present invention in a matching color. FIG. 7B shows a striped pair of socks utilizing the second preferred fastening system of the present invention in a color matching the color of the stripes (e.g., hatching is for green).

FIG. 8A shows a pair of socks utilizing the first preferred fastening system of the present invention within a decorative logo.

DETAILED DESCRIPTION OF THE PREFERRED EMBODIMENTS

Figure 2:
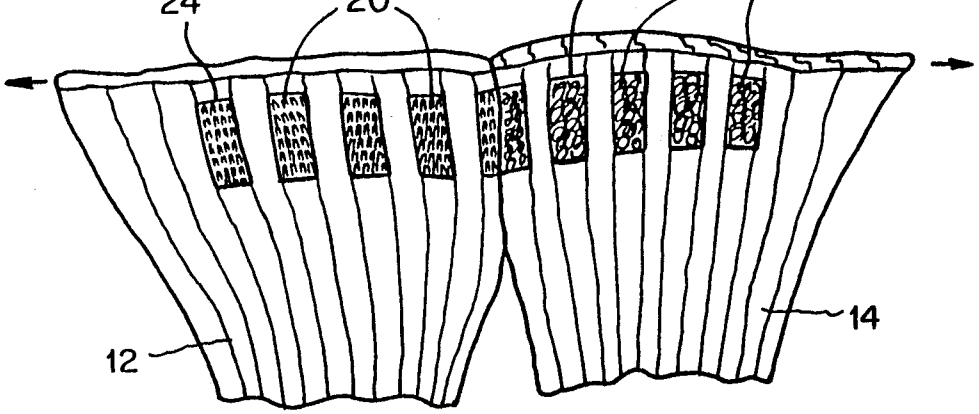
FIG. 2 illustrates the socks with the embodiment of the fastening system illustrated in FIG. 1, showing the fastening system partially separated and stretched apart along the socks' lateral axis.
Figure 3:
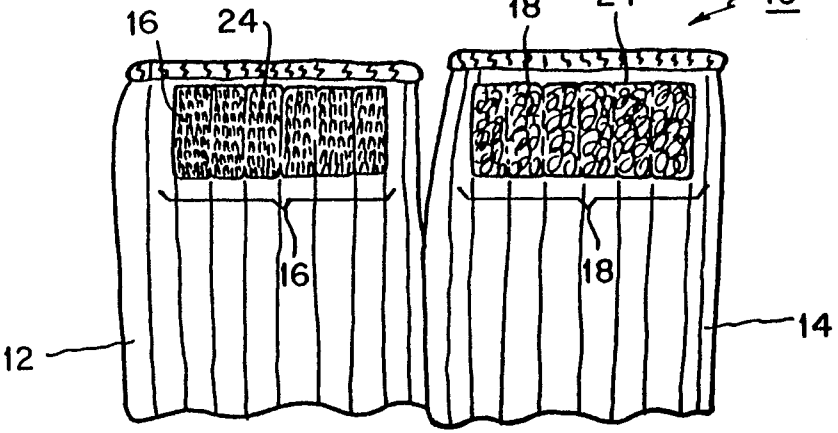
FIG. 3 illustrates the socks and fastening system shown in FIG. 2 with the socks completely separated in a relaxed unstretched position.
Figure 1:
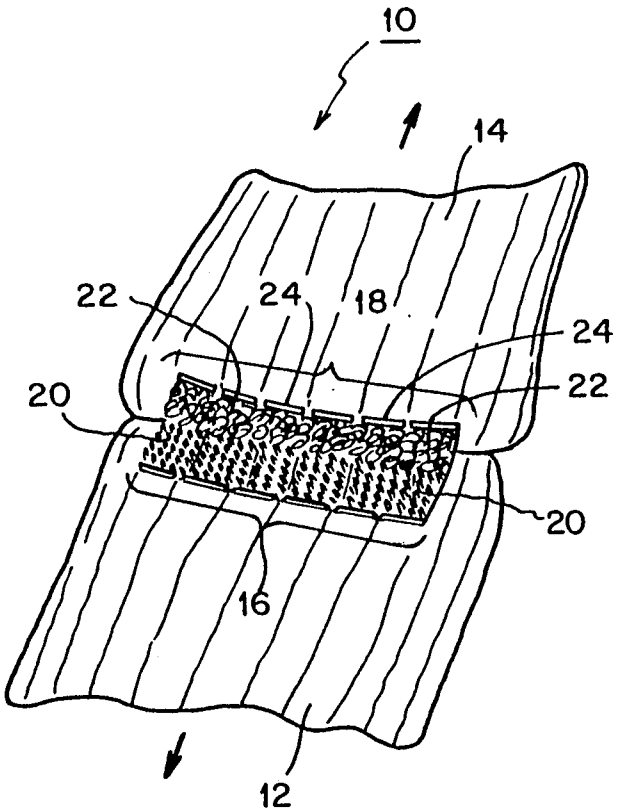
FIG. 1 illustrates a pair of socks utilizing a first preferred fastening system of the present invention partially separated along the socks' longitudinal axis.

In accordance with the preferred embodiments of the present invention, a fastening system is provided for pairing socks, hosiery and similar items, such as gloves. FIGS. 1-3 illustrate a first preferred fastening system in accordance with the present invention. As shown in FIG. 1, a first preferred fastening system 10 include a left sock 12 and a right sock 14. A plurality of fastening means, preferably hook type VELCRO fasteners 16 are attached to the left sock 12, while a plurality of a second fastening means preferably VELCRO loop type fasteners 18 are attached to the right sock 14. The choice of attaching the hook fasteners 16 and the loop fasteners 18, to the left sock 12 and right sock 14, respectively, is unimportant, as long as the fasteners of matching socks are complementary and can be removably attached to each other.

A plurality of fastening means, a plurality of hook type fasteners 16, or loop type fasteners 18, are defined as a grouping of individual segments, each containing a multiplicity of hooks or loops, respectively. Accordingly four individual hook type fastener segments 20 are illustrated in FIG. 2, while six individual hook type fastener segments 20 are shown in FIGS. 1 and 3. The same is true for individual loop type fastener segments 22, which make up the plurality of loop type fasteners 18. As illustrated in FIG. 1, the first preferred fastening system of the present invention is attached and is integral with a pair of socks, and is illustrated with the socks partially separated along the longitudinal axis to show a lower portion of the individual hook type fastener segments 20 making up the plurality of hook type fasteners 16.

FIG. 2 illustrates the socks having the first preferred fastening system 10, showing the socks and fastening system 10 partially separated and stretched apart along the socks' lateral axis. As shown in FIG. 2, when the socks are stretched the separation, between the individual hook type fastener segments 20, and between the individual loop type fastener segments 22, becomes more apparent. The individual hook type fastener segments 20 and individual loop type fastener segments 22 are each separably attached to the socks or hosiery and suitably spaced to allow for expansion, contraction and stretching of the socks or hosiery due to the wearing, laundering and use of the socks, as illustrated in FIGS. 2 and 3.

Preferably, the individual hook type fasteners 20 and individual loop type fastener segments 22 are each separately sewn to the socks, woven as an integral part of the socks, or separately glued to the socks utilizing a heat activated or other suitable adhesive. Other attachment means 24 (not shown) which accomplish attachment of each individual fastener segments 20 and 22 are also suitable for the present invention as would be known to those of ordinary skill in the art. Due to the individual attachment of the individual hook fastener segments 20 and individual loop fastener segments 22, once the socks are completely separated and no longer stretched, the fastener segments orient themselves closer together for complementary pairing and attachment, as illustrated in FIG. 3. This embodiment 10 can also be used for pairing gloves and other items of clothing that may be advantageously paired during periods of non-use, laundering and the like.

Figure 5:
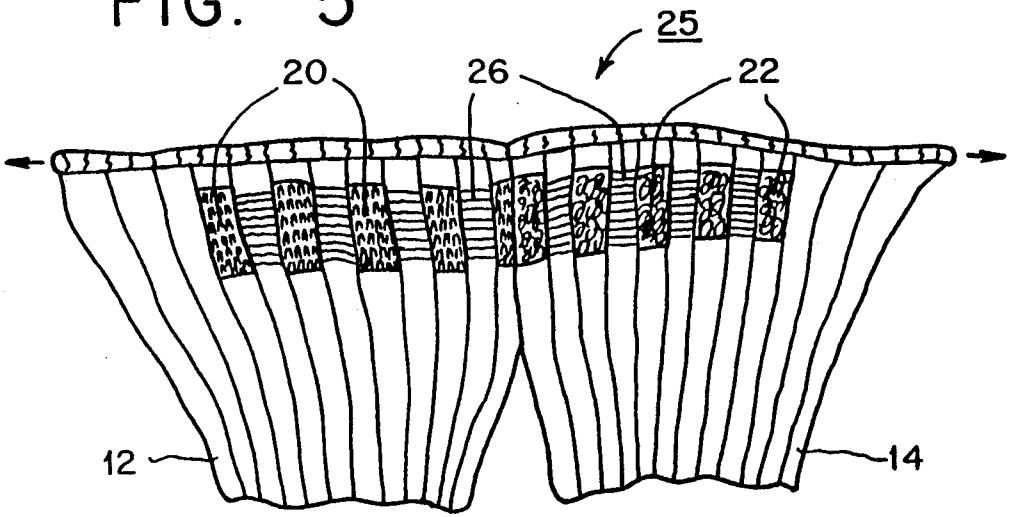
FIG. 5 illustrates the socks with the embodiment of the fastening system illustrated in FIG. 4, in the orientation shown in FIG. 2.
Figure 6:
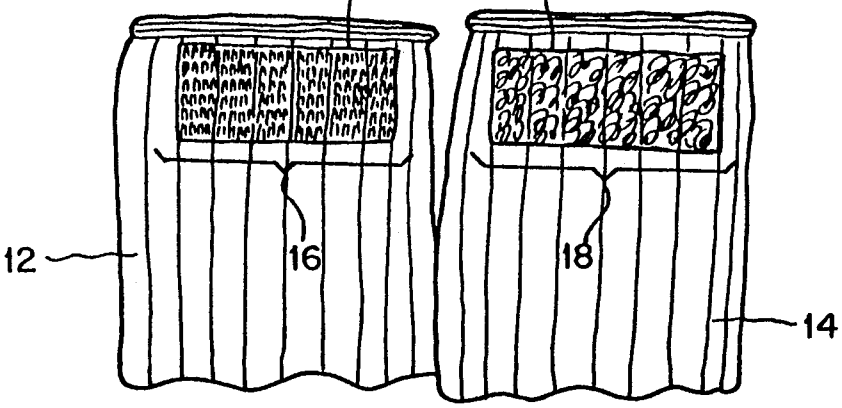
FIG. 6 illustrates the socks and fastening system shown in FIG. 5, in the orientation shown in FIG. 3.
Figure 4:
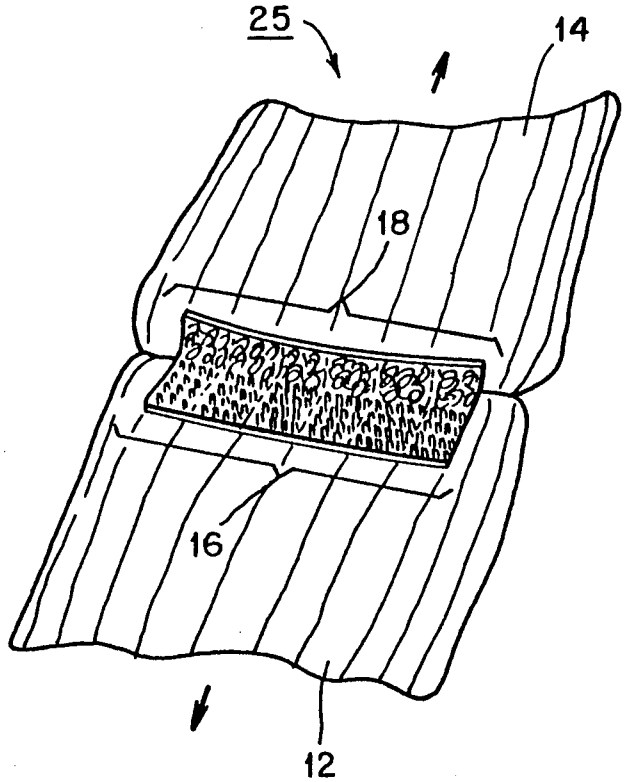
FIG. 4 illustrates a pair of socks utilizing a second preferred fastening system of the present invention in the orientation shown in FIG. 1.

A second preferred embodiment of the present invention 25 is illustrated in FIGS. 4-6. FIGS. 4-6 illustrate a pair of socks including the second preferred embodiment 25 of the fastening system of the present invention in the same orientations shown in FIGS. 1-3, respectively. The second preferred fastening system 25 is the same as the first preferred fastening system except that the individual hook type fastener segments 20 making up the plurality of hook type fasteners 16, and the individual loop type fastener segments 22 making up the plurality of loop type fasteners 18, are not directly attached to the socks 12, 14. Rather, the individual hoop type fastener segments 20, and individual loop type fastener segments 22 are separately adhered to a band of stretchable backing material 26. The stretchable backing material 26 is best illustrated in FIG. 5, where the fastening system 25 is partially separated and stretched apart along the socks, lateral axis. FIG. 5 shows portions of the stretchable backing material 26 between each of the individual hook type fastener segments 20 and individual loop type fastener segments 22, respectively. The stretchable backing material 26 is preferably made from fabric surrounding a plurality of elastic bands that is commonly used in the apparel industry. Other suitable stretchable backing materials 26 that may similarly be substituted for use in the present invention, are well known by those of ordinary skill in the art. In this embodiment 25 the flexible backing material 26 allows for expansion of the individual fastener segments 20 and 22 during laundering and use of the socks and hosiery. As shown in FIG. 6 once the socks have been separated and no longer stretched, the stretchable backing material 26 returns to its original non-stretched orientation that is shown in FIG. 4.

The first and second preferred fastening systems 10 and 25 respectively, can be colored or patterned to match a particular color or pattern of the socks, hosiery and gloves in order to disguise the presence of the fastening system. Accordingly, FIGS. 7A and B illustrate two separate pairs of socks each with a different preferred fastening system according to the present invention. FIG. 7A shows a colored pair of socks (e.g., here the hatching is for green) utilizing the first preferred fastening system of the present invention in a matching color 28 to disguise the presence of this fastening system. As can be seen in FIG. 7A, the plurality of hook type fasteners 16 and the plurality of loop type fasteners 18 blend in with the color (e.g., green in these figs.) of the socks so that they are not detectable by the casual observer.

Figure 7B:
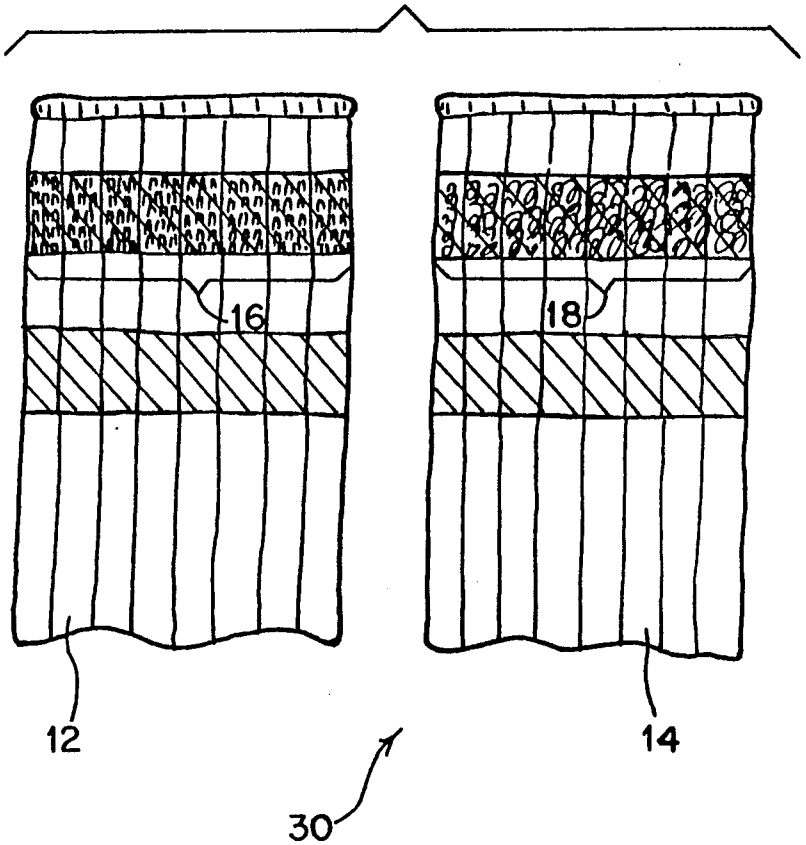
FIGS. 7A and 7B illustrate two pairs of socks with the preferred fastening systems of the present invention.
Figure 7A:
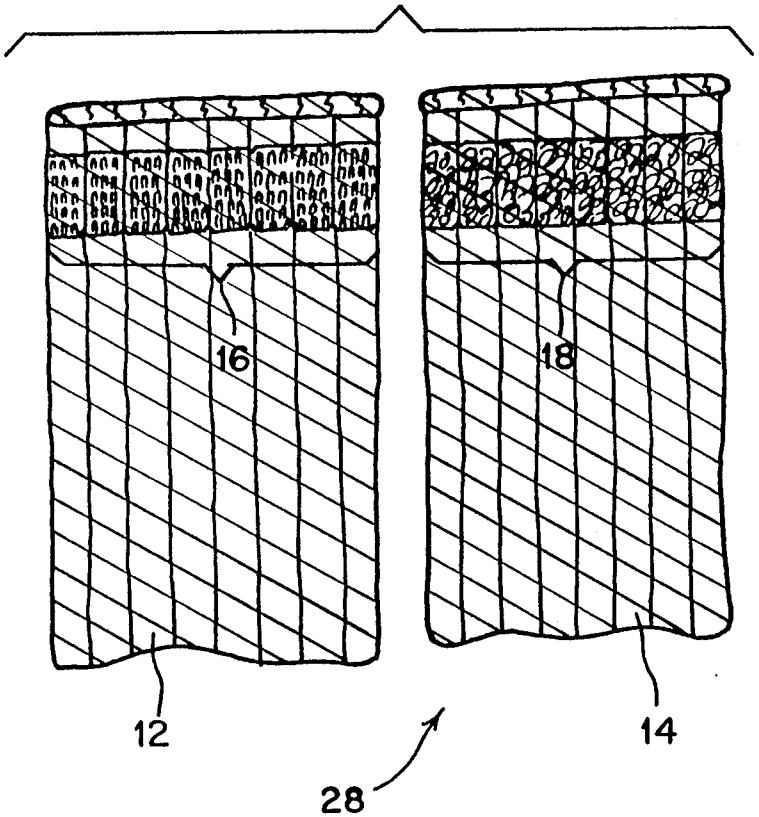

Likewise, FIG. 7B illustrates socks having a striped pattern including a matching colored second preferred fastening system 30 (here the stripes are hatched for green). The plurality of hook type fasteners 16 and plurality of loop type fasteners 18, and preferably the stretchable backing material 26 that attaches these fasteners to the socks, hosiery or gloves is also colored to match the color of the decorative stripe or pattern.

Figure 8A:
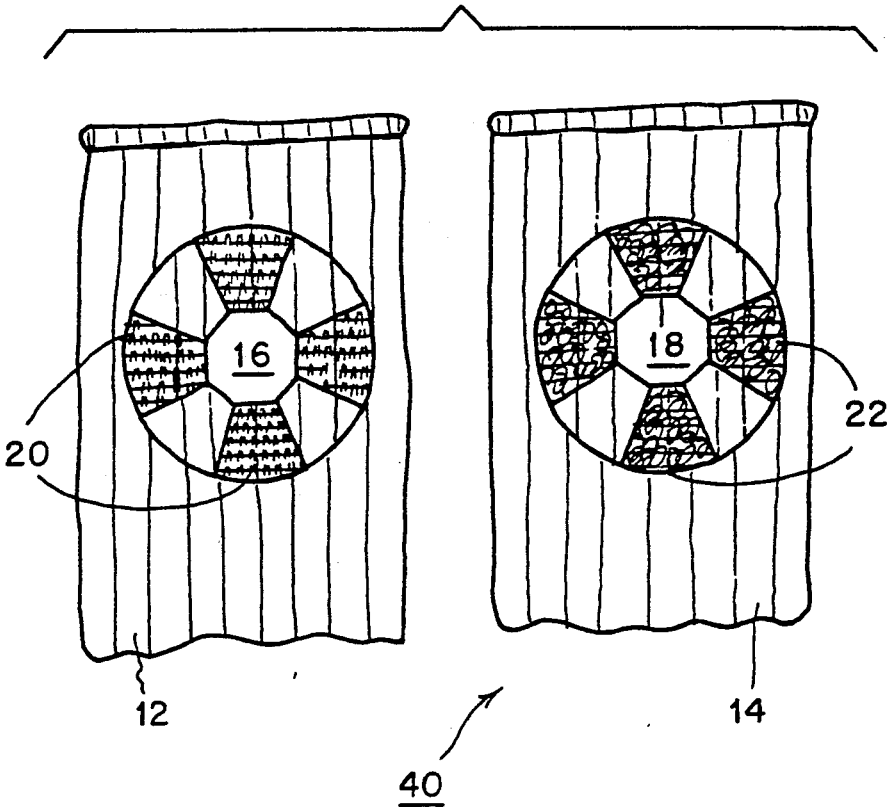
FIGS. 8A, B and C illustrate pairs of socks with the preferred fastening systems of the present invention manufactured in the form of a decorative or logo (a portion of which is lined for blue).
Figure 8B:
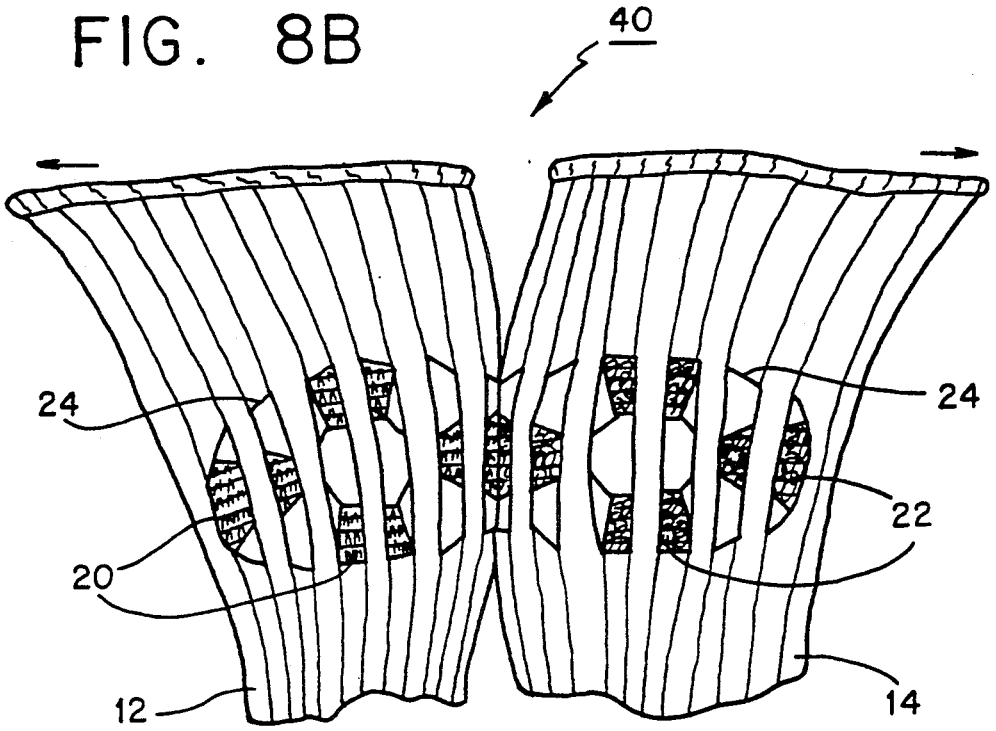
FIG. 8B shows the pair of socks illustrated in FIG. 8A joined at one side by a portion of the fastening system of the present invention, showing the fastening system partially separated and stretched apart along the socks, lateral axis.

Another preferred embodiment of the present invention may be utilized when the socks, hosiery or gloves contain a decorative logo or pattern. FIG. 8A, B and C illustrate two separate pairs of socks with a preferred fastening system 40 and 45 of the present invention manufactured in the form of a decorative or a team logo (a portion of which is lined for blue). FIG. 8A shows a pair of socks utilizing the first preferred fastening system of the present invention within a decorative or team logo 40. In FIG. 8B the socks 12 and 14 are shown in the stretched orientation as illustrated in FIGS. 2 and 5, in order to make the separate individual hook type fastener panels 20 and individual loop type fastener panels 22 more apparent. The use of the individual fastener panels 20 and 22, respectively, within the pattern or background of the decorative pattern or team logo disguises the presence of the attachment means so that only the decorative pattern or team logo is visible to the casual observer.

Figure 8C:
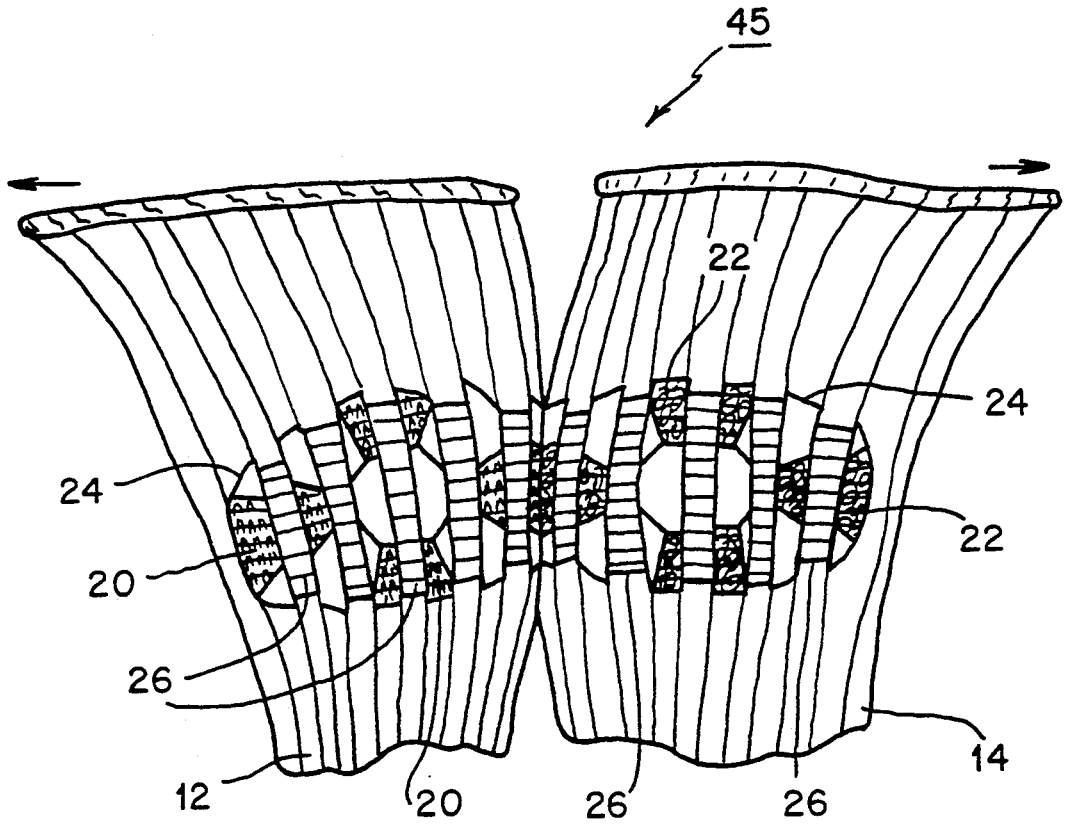
FIG. 8C shows a pair of socks utilizing the second preferred fastening system of the present invention with a decorative logo in the stretched orientation shown in FIG. 8B.

A pair of socks utilizing the second preferred fastening system of the present invention within a decorative or team logo 45 is illustrated in FIG. 8C. The socks are shown in this figure in a stretched orientation, as in FIG. 8B, in order to show the stretchable backing material 26 and individual hook type fastener panels 20, and individual loop type fastener panels 22 within the decorative pattern or team logo. Preferably, the stretchable backing material 26 is made in the same or a color matching the team logo so that the stretchable backing material 26 is also disguised in the pattern or team logo whether the socks are stretched (as in FIG. 8C) or unstretched (like in FIG. 8A). These pattern or logo embodiments 40 and 45 can be suitably used with socks, stockings or gloves, or with other items or clothing which are to be paired.

Thus, while I have described what are the presently contemplated preferred embodiments of the present invention, further changes and modifications could be made by those skilled in the art without departing from the spirit and scope of the invention, and it is contemplated to claim all such changes and modifications.

I claim:

1. A fastening system for pairing socks and hosiery, comprising:

a plurality of a first fastening means including a plurality of hook type fastener panels separately affixed to a first sock or hosiery at a portion of said sock or hosiery that is made from a stretchable material, a plurality of a second fastening means including a plurality of loop type fastener panels separately affixed to a second sock or hosiery at a portion of said sock or hosiery that is made from a stretchable material for complementary attachment to said plurality of said first fastening means, wherein said first fastening means and said second fastening means each have an exterior shape constituted by said individual panels which separate when said portion of said sock or hosiery upon which said panels are affixed, said exterior shape is reconstituted once the sock or hosiery is relaxed.

2. A fastening system as recited in claim wherein said plurality of said first fastening means are individually sewn or woven to said socks or hosiery, and suitably spaced to allow for expansion and stretching of said socks, hosiery or gloves due to wearing, laundering and use.

3. A fastening system as recited in claim wherein said fastening means are separately adhered to a sheet of stretchable backing material that is affixed to said socks or hosiery to allow expansion of said first and said second fastening means during laundering and use.

4. A fastening system as recited in claim 1, wherein said socks or hosiery are colored and said fastening means is the same or matching color, and wherein the color of said socks or hosiery disguises the presence of said fastening means.

5. A fastening system as recited in claim 1, wherein said socks or hosiery have a decorative stripe or pattern, and wherein said fastening means are colored to match the color of said decorative stripe or pattern, and wherein said fastening means are disguised by said decorative stripe or pattern.

6. A fastening system as recited in claim 1, wherein said socks or hosiery include a decorative pattern or logo and said fastening means have a shape and color matching said decorative pattern or logo and are made a part of or background of said decorative pattern or logo, and wherein said fastening means are disguised within the decorative pattern or logo.

7. A fastening system as recited in claim 6, wherein said decorative pattern or logo includes stretchable backing for retaining said pattern or logo and allowing individual segments of said logo and said first and second fastening means to be stretched during the wear, laundering and use of said socks or hosiery.

* * * * *

UNITED STATES PATENT AND TRADEMARK OFFICE

CERTIFICATE OF CORRECTION

PATENT NO. : 5,321,855
DATED : June 21, 1994
INVENTOR(S) : Cuiffo, A.

It is certified that error appears in the above-indentified patent and that said Letters Patent is hereby corrected as shown below:

| | |
|---|---|
| Claim 1, line 18 | now reads "panels are affixed" , should read --panels are affixed is stretched--. |
| Claim 2, line 1 | now reads "as recited in claim wherein", should read --as recited in claim 1 wherein--. |
| Claim 3, line 1 | now reads "as recited in claim wherein", should read --as recited in claim 1 wherein--. |

Signed and Sealed this

Fifth Day of August, 1997

Bruce Lehman

*Attest:*

BRUCE LEHMAN

*Attesting Officer*

*Commissioner of Patents and Trademarks*